United States Patent [19]

Hurd, deceased et al.

[11] Patent Number: 4,687,632

[45] Date of Patent: Aug. 18, 1987

[54] METAL OR ALLOY FORMING REDUCTION PROCESS AND APPARATUS

[76] Inventors: Frank W. Hurd, deceased, late of Corvallis; by Susan M. Hurd, executor, 977 NW. Ironwood, Corvallis, both of Oreg. 97330; by Harland C. Hurd, executor, 1639 Jefferson, Eugene, Oreg. 97402

[21] Appl. No.: 609,393

[22] Filed: May 11, 1984

[51] Int. Cl.[4] ..... C22C 1/00; C22C 14/00; C22C 16/00; C22C 27/02

[52] U.S. Cl. ..... 419/45; 75/84; 75/84.4; 75/84.5; 419/34; 419/46

[58] Field of Search ..... 75/62, 84, 84.4, 84.5; 419/45, 46, 34

[56] References Cited

U.S. PATENT DOCUMENTS

| | | | |
|---|---|---|---|
| 3,455,678 | 7/1969 | Shapiro et al. | 75/84.4 |
| 4,032,328 | 6/1977 | Hurd | 75/84.4 |
| 4,437,888 | 3/1984 | Jecker | 74/84.4 |

FOREIGN PATENT DOCUMENTS

| | | | |
|---|---|---|---|
| 835497 | 5/1960 | United Kingdom | 75/84.5 |

*Primary Examiner*—Allan M. Lieberman
*Attorney, Agent, or Firm*—Jones, Tullar & Cooper

[57] ABSTRACT

A reduction process for the production of a product metal which includes the step of reacting at least one reducible metal compound and a reducing metal in a sealed reaction zone by heating the reactants without any substantial agitation from a temperature below the melting point of the reducing metal to a temperature which is both above the melting point of the reducing metal and below the temperature at which the reduction reaction between the metal compound(s) and the reducing metal will proceed spontaneously; initiating a reduction reaction between the reducible metal compound(s) and a molten reducing metal by causing the surface of the molten reducing metal to be suddenly disrupted, thereupon releasing the reaction mixture from said first reaction zone into a product collection zone while permitting the reduction reaction to continue to thereby produce a reduced metal or alloy in zero valent state; and apparatus for conducting the above process.

7 Claims, 2 Drawing Figures

METAL OR ALLOY FORMING REDUCTION PROCESS AND APPARATUS

BACKGROUND OF THE INVENTION

Competition from materials other than titanium for the use in military and other aircraft (the chief use of alloyed titanium metal) has caused a re-evaluation of the method of preparing the metal for use. While titanium has the best strength-to-weight ratio of any metal, the fact that several pounds of titanium are required to put one pound in place on the aircraft has made the use of titanium prohibitively expensive. Also scrap titanium is difficult to identify, segregate and re-use.

One solution to the high cost of titanium has been a process known as hot isostatic pressing. Here, titanium alloy powder is formed to approximate but oversized dimensions by pressing at high temperatures. Good powder can be pressed to 100 percent of theoretical density. Considerably less scrap results, since only that material which causes the object to be oversized need be removed to bring the piece to the desired dimensions.

Unfortunately for the industry, no consistent, cheap process now exists for producing a specification alloy powder. Apparently, regardless of the process used, the presence of chloride hinders the making of coherent metal.

In addition, the industry has long been plagued by too much oxygen and nitrogen, which are introduced in the grinding, washing and drying steps (see Bureau of Mines report of investigations 4519, August 1949). No washing and drying are required in the practice of U.S. Pat. Nos. 3,801,307 and 4,032,328 by the applicant herein; hence no oxygen, nitrogen or even hydrogen is introduced by these processes. Even the removal of chloride by vacuum distillation has left the titanium "too dirty". (See USBM RI 4837, February 1952). Tests of the prccess of U.S. Pat. No. 3,801,307 have shown very low chloride levels in the resultant metal.

Titanium alloy rather than pure titanium is sought to be employed in aircraft manufacturing. The problems of forming titanium alloys of high purity which are uniform in composition and characteristics is difficult and frequently tends to exacerbate the problems discussed herein above. As discussed above, one of the most promising approaches has been consolidating oversized, highly compressed parts of titanium powder by heating under pressure or vacuum. It has now been possible to achieve over 99 percent theoretical density and to arrive at strength in the fatigue characteristics comparable to that of wrought metal. Some characteristics such as machinability are superior. Two types of powder compacts are under development. Pre-alloyed powder, wherein each powder particle is a uniform alloy and elemental blend, and where pure titanium powder is intimately mixed with powdered alloying metals. The former has been successfully fabricated using hot isostatic pressing, while the most successful elemental blend compacts have been processed under vacuum at temperature. In either case, the consolidation temperature has been above that where alpha phase titanium transforms into beta phase. The pre-alloyed powder is generally considered to be superior in physical properties to the elemental blend powder, particularly in the area of fatigue resistance. A drawback with the elemental blend powder is said to be the high chloride content of the elemental titanium.

The pre-alloyed powder is prepared by disintegrating solid titanium metal which has been fully processed through the stages of sponge manufacture, alloy blending, compaction and consolidation into solid material by consumable electrode arc melting, and conversion to a form suitable for reduction to powder. Since this powder has been arc-melted, all chloride has been volatilized out of it. Also, each resultant powder particle is quite uniform in alloy content.

The elemental blend powder contains the chloride of its parent material and incomplete alloying may be present because the only way the alloying elements can be mixed with titanium is by diffusion. Some degree of in-homogeneity may be anticipated.

DESCRIPTION OF THE INVENTION

Figure 1:
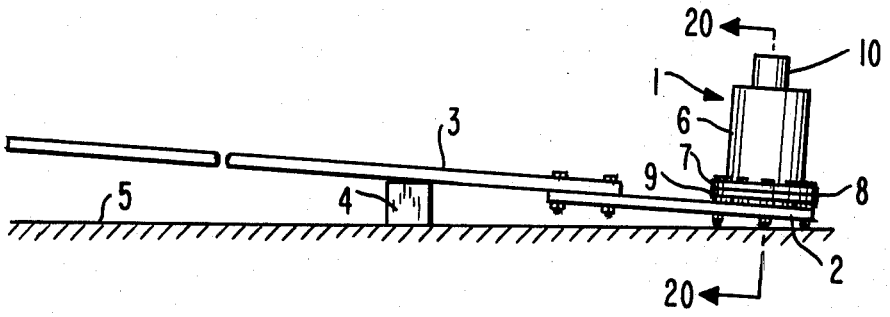
FIG. 1 is a side elevation of an apparatus including a reaction and a containment chamber which can be used in the practice of this invention.

U.S. Pat. No. 3,801,307, incorporated herein in its entirety by reference, describes a metal reduction process which permits the efficient production of metals from reducible metal compounds by means of a reducing metal, a reducible metal compound and a stoichiometric amount of a reducing metal are introduced into a sealed reaction zone and heated to a temperature which is above the melting point of the reducing metal but below the temperature at which a reduction reaction between the reducible metal compound and the molten reducing metal will proceed spontaneously. In this temperature range, a reduction reaction is initiated between the reducible metal compound and the molten reducing metal by suddenly disrupting the surface of the molten reducing metal and allowing the reduction reaction to continue to completion. This general process can be employed in the process and apparatus of this invention.

U.S. Pat. No. 4,032,328 hereby incorporated in its entirety by reference, is an improvement upon the previous patent and describes a metal reduction process wherein the reaction between a reducible metal compound and a reducing metal in approximately stoichiometric amounts is conducted in an innerbeneficial container, separated from the exterior reactor walls by an insulating material. In a preferred embodiment, the reducible metal compound and the stoichiometric amount of a reducing metal are introduced into a container formed from a metal which is the same as the desired metal being produced, or a metal alloyable therewith. The container is retained in a reaction vessel being separated from the walls of the reaction vessel by an inert insulating material. The container is then heated to a temperature which is above the melting point of the reducing metal compound but below the temperature at which a reduction reaction between the reducible metal compound and the molten reducing metal will proceed spontaneously. Again as above, in this temperature range, a reduction reaction is initiated between the reducible metal compound and the molten reducing metal by suddenly disrupting the surface of the molten reducing metal and allowing the reduction reaction to continue to completion. The container in which the reactants have been placed may remain intact, or may melt and comingle with the product of the reduction reaction.

The present invention relates in one part to the preparation of metal alloys by direct reduction of a reducible metal compound, e.g. titanium tetrachloride together with at least one reducible metal compound of an alloying metal, e.g. a chloride of at least one alloying element, by a reducing agent such as sodium. For best results, the reducible metal compound of the alloying element should be soluble in the principle reducible metal compound at the temperature of reduction.

The invention specifically relates in a second aspect to an improved apparatus for conducting reactions such as described in U.S. Pat. Nos. 3,801,307 and 4,032,328 or the alloying process described herein. The construction of the improved apparatus is based on the fact that when titanium tetrachloride and sodium are shaken together at temperatures slightly above the melting point of sodium, a sharp, explosive-like reaction occurs. Advantage can be taken of this rapid increase in temperature and pressure to improve the yield of the resultant powdered titanium metal or titanium metal alloy. The explosion is allowed to take place in one vessel or reaction zone, this vessel being separated from another vessel or reaction zone by a frangible diaphragm, which breaks shortly after the product titanium metal and by-product sodium chloride are formed in the first vessel. The resultant titanium or titanium alloy spreads rather uniformly over the interior surface of the second vessel and the yield of this powder on occasion has approached 100 percent of the titanium or titanium alloy produced.

The secondary product receiving vessel, or zone, should be of a size sufficient so that the reaction mass existing in the first reaction vessel or zone is dispersed into a particulate material which impinges the vessel or zone surface in a manner to avoid significant coalescence of the particulate material.

The improved apparatus of the invention provides an apparatus better adapted to provide particulate product metal or alloy as compared to the apparatus described in applicant's prior patents.

The process of the present invention is applicable to any metal compound which can be reduced with a molten reducing metal. Such reducible compounds include the halides, oxides and sulfides of titanium, zirconium, hafnium, vanadium, niobium, tantalum, silicon, germanium, tin, lead, thorium, uranium, boron, beryllium, and the like. Among the various compounds of these metals, the metal salts of the common inorganic acids are preferred. The metal halides are particularly preferred, especially the halides of the metals found in groups IVA, IVB, VA, VB, VIA and VIB of the Periodic Chart. To a somewhat lesser extent, the halides of metals of groups IIIA, IIIB, and the actinoid series can be used to advantage in the present process.

Illustrative reducible metal compounds are $TiCl_4$, $TiBr_4$, $TiF_4$, $ZrCl_4$, $BeCl_2$, $SnCl_4$, $NbCl_5$, $VCl_4$, $TaCl_5$, $UCl_4$, $UF_6$, $ThCl_4$, $Fe_2O_e$, $Nb_2O_5$, CoO and $MoS_2$.

In the alloying process of the invention, broadly, the principal reducible metal compound is admixed with minor amounts of a reducible metal compound of the metal sought to be alloyed with the principal metal. One or more alloying compounds can be employed. In a preferred embodiment, the principal alloying metal compound and the alloying metal compound are selected such that they are both liquid or molten and soluble in each other, in the proportions present, at a temperature which is the melting point of the reducing agent present.

The metals which can be used as reducing agents in the present invention include any metal which is capable of reducing the selected reducible metal compound. As is known in the art, metals which will reduce certain compounds will not reduce all compounds. However, the selection of a suitable reducing compound is within the skill of the art once the reducible metal compound is identified or selected.

The reducing metals used in the practice of this invention can be selected from the group consisting of alkali metals, such as lithium, sodium, and potassium; the alkaline earth metals, such as magnesium, barium, and calcium, aluminum, and the rare earth misch metals.

Preferred reducing metals include sodium, magnesium, potassium, lithium, barium, calcium and mixtures thereof. Sodium, mixtures of sodium with barium, sodium with calcium and sodium with potassium are particularly useful as reducing metals for reducible metal halide compounds, such as $TiCl_4$, $BeCl_2$, $ZrCl_4$, $VCl_4$, $NbCl_5$, $TiBr_4$, $TiF_4$, and $UF_6$.

Although aluminum is not a good reducing metal for producing metals or alloys from reducible metal halide compounds, it does function satisfactorily as a reducing metal for other reducible metal compounds, such as $Fe_2O_3$, $Cr_2O_3$, $TiO_2$, $ZnO_2$, $V_2O_5$, and mixtures of FeO and $TiO_2$.

In many instances, the selection of the reducible metal compound is limited by the availability in commercial quantities of reducible compounds of the selected metal. For example, titanium tetrachloride is commercially available or can be prepared from commercially available raw materials. Accordingly, titanium tetrachloride is one primary source of titanium metal.

1. The ability of the reducing metal to react with the reducible metal compound or compounds under the anticipated conditions of use.

2. The melting point and boiling point of the reducing metal compared to those of the reducible metal compound or compounds.

3. The cost and commercial availability of the reducing metal.

4. The relationship between the melting point of the reducing metal and the thermal initiation temperature for the reduction reaction for the selected combination of reducible metal compound or compounds and reducing metal.

5. The type of by-products produced during the reduction process.

As previously indicated, particularly effective combinations of reducible metal compound and reducing metal are the combination of titanium tetrachloride and sodium metal.

The preferred alloying combination is titanium tetrachloride admixed with $SnCl_4$, $SiCl_4$, $MoCl_5$, $WCl_6$, $ZrCl_4$, $HfCl_4$, $TaCl_5$, and $NbCl_5$, $AlCl_3$, $VCl_4$, and possibly $FeCl_3$. There are naturally some alloys of titanium which are superior or more desirable in physical characteristics and wroughtability than most others. One of the better alloys is the so-called 6-4 alloy, which contains 6 percent aluminum and 4 percent vanadium. This same 6-4 alloy comprises about half the high-strength titanium materials used in the aerospace industry. In implementing the alloy preparation of titanium, it is necessary to arrive at conditions for the dissolution of the chlorides of aluminum and vanadium in titanium tetrachloride. Vanadium tetrachloride is miscible in all proportions with titanium tetrachloride at room temperature. Aluminum chloride is not. However, by raising the temperature of an aluminum chloridetitanium chloride mixture, aluminum chloride will dissolve. The literature figure is 283 grams per liter at 137° C. Since 137° C. is a good temperature for the performance of a titanium reduction, all that needs to be done is to add $TiCl_4$, $AlCl_3$ and $VCl_4$ and sodium to a vessel under an argon atmosphere, seal the vessel, and heat it to 137° under such time as the $AlCl_3$ dissolves completely and then cause a reduction to occur by vigorously agitating the sealed vessel. Since the alloying chlorides are uniformly dissolved in the titanium tetrachloride, the resulting aluminum-vanadium alloy with titanium is also uniform.

When possible, the relative amounts of reducing metal and reducible metal compound (or alloying mixture) which are used in the practice of this invention should be substantially stoichiometric. Ordinarily, it is not necessary to use any significant excess of either of the reactants, and the use of substantial excesses, for example, over 25 percent excess of either reactant, should be avoided. Ordinarily, the process of this invention requires less than 10 percent excess of either reactant, and desirably less than 5 percent excess of either reactant. Preferably, less than 1 percent excess of either reactant is most desirable.

The temperature at which the reaction of the present invention is initiated, by the sudden disruption of the surface of the molten reducing metal, is below the boiling point of the reducing metal and can range from the melting point of the reducing metal up to within about 50° C. of the "thermal initiation temperature" for the reduction reaction.

By "thermal initiation temperature", it is meant the temperature to which the reactants must be heated at rest in a sealed reaction vessel to cause the reactants to react spontaneously without disrupting the surface of the molten reducing metal and then to continue to react to completion without the benefit of externally supplied heat or agitation.

By contrast, initiation of the process of the present invention is characteristically induced at temperatures significantly below the thermal initiation temperature. Thus, if one heats the reactants to an initiation temperature as taught herein (i.e., significantly below the thermal initiation temperature), and either does not mechanically initiate the reduction reaction by intentionally disrupting or proliferating the surface and body of the molten metal, or inadequately manipulates the reactants in mechanically initiating the reduction reaction, little or no reaction will occur and the reaction will not proceed to completion.

Desirably, the temperature at which the process of the present invention is initiated will be the minimum required to achieve an acceptable rate of reaction when the surface of the molten reducing metal is sharply disrupted in the presence of the reducible metal compound. In the present invention, the preferred temperature of initiation is more than 100° C. and usually more than 200° C. below the thermal initiation temperature.

Frequently, a combination of reducible metal compound or compounds and reducing metal can be selected so that there is a broad temperature range, for example, several hundred centigrade degrees, over which the reaction could be induced or mechanically initiated. However, once initiated, the reducing reaction is exothermic and the temperature will rise above the calculated thermal initiation temperature. With this in mind, it is advantageous in the present invention to select the lowest initiation temperature that meets many or all of the following objectives:

a. The temperature should provide an acceptable rate of reaction when the reaction is initiated;

b. the temperature should be at or above the boiling point of the reducible metal compound; and c. the temperature should be high enough to cause the exothermic temperature reached during the reaction to be sufficient enough to maintain the reduced metal and by-product salt above their melting points and to produce a corresponding pressure in the primary reaction vessel which is high enough to rupture the primary reaction vessel but not to rupture the secondary containment vessel.

When using magnesium or sodium as the reducing metal, and using titanium tetrachloride as the sole or principal reducible metal compound, the thermal initiation temperature for the reduction reaction is ordinarily in excess of 600° C., and thermally initiated reduction processes, such as the Kroll process, are typically carried out within the temperature range of from 700° C.–850° C. By contrast, the present process can be carried out at temperatures as low as the melting point of sodium (about 98° C.). A very useful initiation temperature for the present process, using sodium metal as the reducing metal and titanium tetrachloride as the reducible metal compound, is from 120°–400° C.

The reduction process of the present invention is initiated by disrupting the surface of the molten reducing metal after it has been heated to the temperature previously indicated. This can be accomplished by abruptly shaking or jarring the reaction vessel or zone, by rapid agitation of the reactants, or by any other means which produces a sudden material change in the shape or area of the surface of the molten metal which is exposed to or in contact with the titanium tetrachloride.

Disrupting the surface of the molten metal results in a proliferation or dispersion of freshly exposed reducing metal into intimate contact with the reducible metal compound. This disruption or proliferation of the molten metal serves to initiate the reduction reaction in the present invention. Another way of viewing this phenomenon is to consider that the thermal initiation temperature under quiescent conditions, that is the "thermal initiation temperature" of the prior art, is higher than the initiation temperature under conditions wherein molten reducing metal is being dispersed or proliferated as in the present invention.

Although a variety of means can be used to disrupt or proliferate the molten reducing metal, axial (usually vertical) agitation, that is agitation in a direction perpendicular to the surface of the molten metal, is much more effective than, for example, side to side shaking or rotary mixing in vertically oriented cylindrical reaction vessels. Thus, the direction of agitation can be important and should ordinarily be performed in the direction or manner which results in the best or most efficient proliferation of the molten reducing metal. With cylindrical reaction vessels, agitation in the direction of the axis is preferred. For example, end-on-end mixing against the flattened ends of the reaction vessel is particularly beneficial.

In the preferred apparatus of the invention, once initiated, heat is produced by the reduction process in the primary reaction vessel which correspondingly increases the pressure inside the primary reaction vessel. The primary reaction vessel must necessarily be designed to be rupturable at the resultant temperature and pressures produced by the presently employed reduction process. The construction and design of rupturable vessels are apparent to one with skill in the art.

The primary reaction chamber can either be rupturable in any part or contain a rupturable diaphragm. All rupturable components, e.g. diaphragms or primary reaction chambers, are designed to rupture during the explosive reaction between the reducible metal compound and the reducing metal. The type of metal or alloy as well as their thickness is determined by the selection of reaction components and should be obvious to one skilled in the art.

For the purposes of the present invention in relation to the scope of terms as used in the specification and the claims, the term "rupturable" means rupturable at the conditions of temperatures and pressures which are obtainable upon the reaction of the reducible metal components and the reducing metal as used in the present process. Accordingly, the term "non-rupturable" means non-rupturable at the same condition of the present process.

When the primary reaction chamber is totally rupturable, it necessarily must be completely encompassed by a non-rupturable secondary containment chamber. The secondary containment chamber can be of any suitable size such that it totally encompasses the primary reaction chamber provided that the secondary chamber is of a size sufficient so that the particulate product mass which results when the reaction chamber is breached is large enough to allow dispersion of the particles in a manner to avoid substantial coalescence. For example, the diameter of the secondary containment chamber of the primary reaction chamber can be about twice to ten times the diameter of the reaction chamber. The size and shape of the secondary chamber is not unduly critical so long as the dispersed, non-coalesced particulate product is obtained.

When the primary reaction vessel is completely encompassed by the secondary containment chamber, the two vessels can be geometrically similar, e.g. both vessels are spherical or cubicle or geometrically dissimilar, e.g. one chamber is spherical and the other is cubicle.

In an alternative and presently preferred embodiment, the primary reaction chamber can be formed from a non-rupturable container having a rupturable diaphragm. Thus, the primary reaction chamber can be employed in many sequential reactions producing metallic powder such as titanium as only the diaphragm must be replaced after each explosion. When the primary reaction chamber contains a rupturable diaphragm, this chamber can be totally contained within the secondary containment chamber.

In an alternative embodiment, the secondary containment chamber need only connect to the primary reaction chamber in a manner such that at least the total area of the rupturable diaphragm be contained within or connected to the secondary containment chamber so that the diaphragm forms a common wall within the two containers. This embodiment includes the use of connecting means as is displayed by a non-rupturable tube or passageway connecting the rupturable area of the diaphragm in the primary reaction chamber to the secondary containment chamber. In instances where a connecting tube or passageway is employed between the reaction and containment chambers it is desirable to initially line the connecting tube with a material such as calcium fluoride to prevent explosively formed metallic particles from adhering to the walls of the connecting tube.

Due to the high heat of reaction created in performing the process of the present invention, the rupturable components, e.g. the diaphragms or the primary reaction chamber, can be melted during the explosive reaction which ruptures these components thus alloying the metal or alloy which make up these components with the resultant metal powder formed from the explosive reaction. It may then be preferable to use rupturable components made from desirable alloying components in some instances or to use the same metal in the rupturable components as is sought in the explosive reaction in order to form an essentially pure reaction product.

The reaction and containment chambers can take any of a variety of shapes. Apparatus suitable for practicing this invention on a laboratory scale is shown in the drawings.

In FIG. 1, a secondary containment chamber 1, is attached to a supporting arm 2 which is bolted to an extension arm 3. Extension arm 3 extends over a block 4 which serves as fulcrum. Block 4 rests on floor 5.

Containment chamber 1 comprises a cylindrical body 6, the upper end of which is attached to the reaction vessel 1. The other end of cylindrical body 6 is provided with an outwardly extending annular flange 7 which is provided with means, such as bolts, for fastening gasket 8 and cover 9 to cylindrical body 6. Reaction vessel 1 is further adapted for attachment to supporting arm 2. The primary reaction chamber 10 is attached to the secondary containment chamber by suitable securing means such as bolts and if desired, a sealing gasket (in addition to the diaphragm employed).

Figure 2:
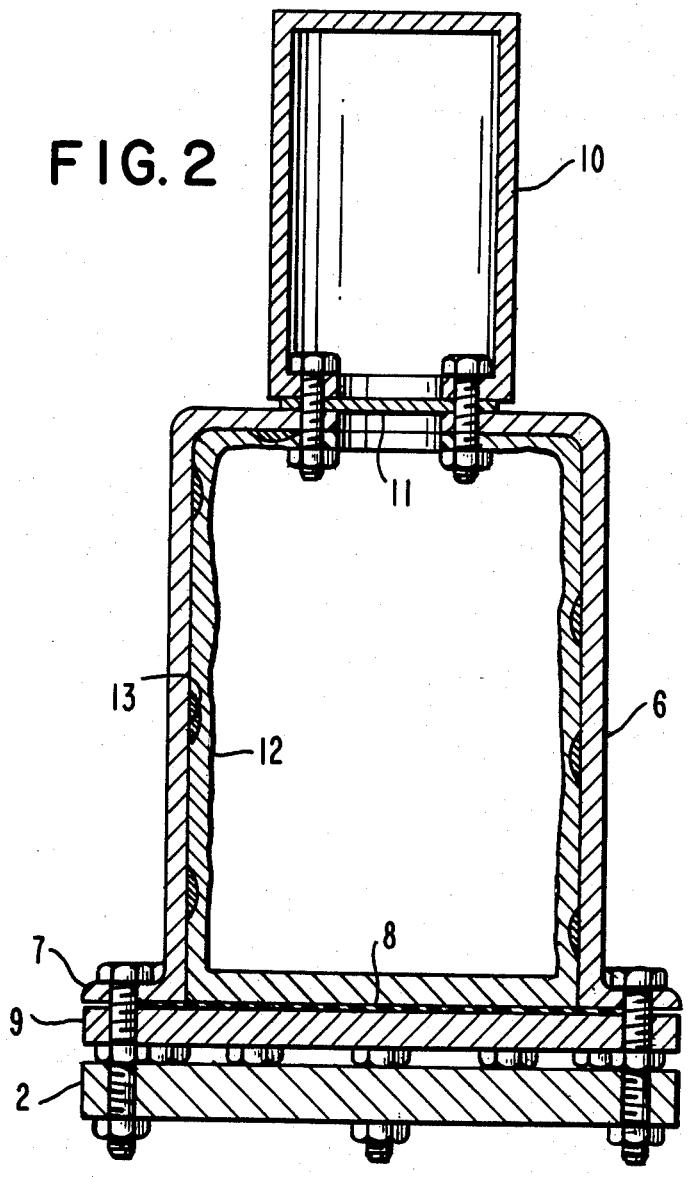
FIG. 2 is a cross-sectional view of the containment chamber and the reaction chamber shown in FIG. 1. The view is taken along lines 20—20 in the direction of the arrows in FIG. 1.

The details of the construction of the primary reaction chamber 10 and the secondary containment chamber 1 are more clearly shown in FIG. 2.

In operation, both the secondary containment chamber 1 and the primary reaction chamber 10 are disassembled and evacuated and purged with an inert gas, such as argon. Then, while operating in an inert atmosphere, with the chambers inverted from their operating mode, the reducing metal and the reducible metal compound, in stoichiometric proportions, are placed in the primary reaction chamber 10 in quantities sufficient to, for example, fill approximately 40–80 percent of the volume of the reaction chamber 10. The diaphragm 11 is then placed and secured between the reaction chamber 10 and an opening in the body of the secondary containment chamber 6 is adapted to conform to the opening in the primary chamber, through the use of coupling means, e.g. bolting, as the membrane seals the opening and is secured therein. After the primary reaction chamber 10 has been secured to and sealed from the secondary containment chamber 1, the assemblage is inverted and the containment chamber 1 is then sealed by attaching the cover 9 to the cylindrical body 6 with suitable bolts and a cooper gasket 8. The containment chamber 1 is then attached to supporting arm 2. The contents of the primary reaction chamber 10 are then heated to the desired temperature. This heating can be accomplished by various heating means including the use of a heating mantle encircling the reaction chamber 10. After the desired temperature has been reached, heating is discontinued.

Next, the reduction reaction is initiated by quickly or sharply disrupting the surface of the molten metal within reaction chamber 10. Although various means can be used to accomplish this purpose, a convenient laboratory method is to suddenly depress or rotate extension arm 3 about fulcrum 4 one or more times in rapid succession to provide sharp vertical agitation.

While not wishing to be bound by any theory, it has been observed that a coating forms on the surface of the molten metal which is in contact with the reducible metal compound and it is believed that this coating or surface layer inhibits the reduction reaction until either the temperature is raised high enoough to thermally initiate the reaction, for example, by causing the molten metal to boil, or until the surface of the molten metal is sharply disrupted to thereby expose fresh molten metal. By initiating the reaction in the latter manner, such as by mechanically disrupting the surface of the molten metal, the reaction can be started at a lower temperature and the enormous pressures associated with the prior art processes can be avoided. In the case of reducible compounds of polyvalent metals, this may be the result of a shift in the reaction mechanism and for the reaction kinetics.

For example, once the reaction between titanium tetrachloride and sodium is initiated by disrupting or proliferating the surface of the molten sodium the reaction proceeds spontaneously. The reaction is exothermic and it has been observed that some or all of the reaction chamber 10 will take on a red glow as the reaction proceeds. During the reaction the temperature and the pressure builds up to a point at which the diaphragm 11 ruptures as an explosive reaction occurs and the interiors of primary reaction chamber 10 and the secondary containment chamber 6 become covered with a thin layer, a combination of metallic powder 12, such as titanium, and the reducing metal salt 13 such as sodium chloride as well as excess reactants. The chambers are allowed to cool, then are disassembled and the powder and salt combination is recovered and separated by any suitable separation technique such as leaching in order to recover the powder metal product.

The present invention is further illustrated by the following specific examples which evidence the applicability of the present invention to reducible metal compounds of titanium, zirconium, hafnium uranium, vanadium, niobium, thorium, beryllium, and molybdenum. As can be seen from the following examples, the process of the present invention is particularly useful in the production of titanium, zirconium, hafnium, uranium, vanadium, niobium and thorium from reducible halide compounds of these metals.

Unless otherwise indicated in the following examples, all parts and percentages are by weight.

EXAMPLE 1

This example illustrates the improved powder metal production and recovery process of the present invention using titanium tetrachloride as the reducible metal compound and sodium as the reducing metal.

The apparatus used in this example was of the type shown in FIG. 3. The primary reaction chamber was a cylindrical vessel four inches in diameter and six inches long, while the secondary containment vessel was eight inches in diameter and twelve inches long. A 0.040 inch thick aluminum diaphragm is used as a partial common wall between the cylindrical ends of the primary reaction chamber and the secondary containment vessel.

Stoichiometric amounts of liquid sodium and titanium tetrachloride were caused to react explosively in an argon atmosphere in the primary reaction chamber. The force of the explosion burst the aluminum diaphragm between the primary reaction chamber and the secondary containment chamber. The resultant products were dispersed uniformly in discrete particulate form on the walls of both chambers. After washing out the by-product sodium chloride from the recovered particles, a dark gray powder remained which was both titaniferous and metalliferous. Three-sevenths of the powder was recovered from the primary reaction chamber and four-sevenths was recovered from the secondary containment chamber.

EXAMPLE 2

In this example, titanium metal was again produced from titanium tetrachloride and liquid sodium. The only variance from the apparatus and procedure from Example 1 was that a 0.25 inch thick aluminum diaphragm was employed between the primary reaction chamber and the secondary containment chamber.

When the stoichiometric amounts of titanium tetrachloride and liquid sodium were explosively reacted, a considerable amount of the aluminum diaphragm melted, thereby alloying aluminum with the resultant titanium powder metal product. Sizeable portions of powder were recovered lying in the size range of 35 to 325 mesh. The powder passing through the 325 mesh also contains metal. X-ray diffraction analysis of the recovered powder indicated that a titanium aluminum alloy is present in the sludge decanted with wash water to remove the sodium chloride from the larger size powders.

EXAMPLE 3

In a manner similar to the previous examples, a titanium, aluminum, vanadium alloy was prepared by charging the reaction chamber with amounts of $TiCl_4$, $AlCl_3$ and $VCl_4$ to provide at 6% Al, 4% V titanium alloy (taking into account the contribution of aluminum from the diaphragm) together with a stoichiometric amount of sodium under an argon atmosphere. After elevating the temperature to obtain $AlCl_3$ dissolution, the mixture was caused to react explosively in the reaction chamber rupturing the diaphragm as in the previous examples. The recovered particular material in the two runs was analyzed as follows:

RUN 1

A representative portion of this sample was mixed with epoxy and cast into a metallographic mount. The mount was examined in the electron microprobe after grinding and polishing the surface and cross-sectioning a number of particles. Al, V, Ti and Fe were found in all metallic particles (Prills). Fourteen typical prills were selected at random for Al and V analysis and ten more for Al and Fe analysis. Each grain was analyzed in two places for Al and V and results are listed in Table 1. A good correlation is seen to exist between Al and V, but no correlation between Al or V content and length across the face of a particle was noted. The average Al and V analysis was 7.2 wt % and 4.2 wt % respectively. Eliminating particle 10 from the list changes average Al to 6.3% and V to 3.6%. It is likely that the overall average of a large number of particles is near the desired 6% Al and 4% V. Results of analysis for Al and Fe are shown in Table 2. Al and Fe values also correlate directly.

TABLE 1

| Microprobe Analysis of Na Reduced Ti—V—Al Chloride | | | |
|---|---|---|---|
| Prill | Wt % Al | Wt % V | Length Across Particle |
| 1 | 10.9 | 2.6 | 1.2 mm |
| | 11.3 | 3.2 | |
| 2 | 5.1 | 3.0 | 0.3 |
| | 5.0 | 3.3 | |
| 3 | 7.6 | 4.5 | 0.4 × 0.6 |
| | 8.1 | 5.1 | |
| 4 | 3.2 | 1.7 | 0.1 |
| | 3.1 | 1.8 | |
| 5 | 4.5 | 2.7 | 0.2 |
| | 4.1 | 2.3 | |
| 6 | 6.2 | 3.8 | 0.4 |
| | 7.4 | 5.2 | |
| 7 | 12.8 | 7.6 | 0.05 |
| | 13.0 | 7.7 | |
| 8 | 4.8 | 3.0 | 0.2 |
| | 4.9 | 3.1 | |
| 9 | 5.4 | 3.0 | 0.5 |
| | 5.2 | 3.1 | |
| 10 | 19.2 | 12.4 | 0.5 |
| | 18.9 | 11.7 | |
| 11 | 4.9 | 4.3 | 1.0 |
| | 4.1 | 2.7 | |
| 12 | 4.2 | 2.7 | |
| | 4.3 | 2.9 | |
| 13 | 2.9 | 1.6 | |
| | 3.1 | 1.6 | |
| 14 | 8.5 | 5.2 | |
| | 8.8 | 5.6 | |
| | 7.2 Ave. | 4.2 Ave. | |

TABLE 2

| Prill | Wt % Fe | Wt % Al |
|---|---|---|
| 15 | 0.4 | 4.2 |
| 16 | 0.5 | 5.7 |
| 17 | 0.9 | 9.9 |
| 18 | 0.3 | 4.7 |
| 19 | 0.2 | 3.5 |
| 20 | 1.2 | 11.8 |
| 21 | 0.5 | 4.4 |
| 22 | 0.5 | 7.4 |
| 23 | 0.5 | 5.0 |
| 24 | 0.9 | 8.2 |
| | 0.6 Ave. | 6.5 Ave. |

RUN 2

Sample 1 = −12+200 powder
Sample 2 = −24+100 powder
Sample 3 = −100+200 powder

Portions of each sample were moulded, polished and examined in an electron microprobe. Al and V have about the same scatter as the previous run, and they appear to be lowest in the small size fraction. Two locations on each randomly selected particle were analyzed and the results are listed in Table 3.

TABLE 3

| Analysis of Individual Particles in each Sample Wt % Element | | | | | | |
|---|---|---|---|---|---|---|
| | Sample 1 | | Sample 2 | | Sample 3 | |
| | Al | V | Al | V | Al | V |
| 1 | 3.1 | 1.7 | 4.4 | 2.8 | 3.5 | 2.5 |
| | 2.4 | 1.2 | 4.2 | 2.8 | 3.3 | 2.3 |
| 2 | 4.7 | 2.6 | 5.0 | 3.7 | 10.8 | 5.8 |

TABLE 3-continued

| Analysis of Individual Particles in each Sample Wt % Element | | | | | | |
|---|---|---|---|---|---|---|
| | Sample 1 | | Sample 2 | | Sample 3 | |
| | Al | V | Al | V | Al | V |
| | 4.9 | 3.1 | 4.6 | 3.3 | 10.6 | 6.1 |
| 3 | 5.1 | 3.6 | 7.6 | 5.2 | 1.5 | 0.6 |
| | 7.2 | 4.3 | 7.8 | 5.2 | 1.5 | 0.6 |
| 4 | 7.2 | 4.1 | 8.1 | 4.6 | 4.3 | 3.2 |
| | 15.7 | 5.0 | 8.7 | 4.7 | 4.4 | 3.3 |
| 5 | 4.3 | 2.6 | 5.6 | 3.4 | 1.5 | 0.5 |
| | 4.4 | 2.5 | 5.7 | 3.4 | 1.7 | 0.9 |
| 6 | 3.1 | 1.7 | 9.0 | 4.7 | 10.3 | 6.7 |
| | 3.1 | 1.7 | 6.9 | 4.1 | 10.4 | 6.7 |
| 7 | 4.1 | 2.5 | 3.3 | 1.6 | 4.6 | 2.6 |
| | 3.8 | 2.5 | 3.1 | 1.8 | 4.9 | 2.7 |
| 8 | 8.3 | 5.2 | 3.9 | 2.6 | 1.8 | 0.7 |
| | 8.5 | 5.3 | 4.0 | 2.6 | 1.7 | 0.9 |
| 9 | 10.6 | 7.3 | 6.9 | 4.9 | 2.2 | 1.1 |
| | 8.3 | 4.8 | 7.6 | 4.7 | 1.7 | 1.0 |
| 10 | 4.6 | 2.7 | 3.3 | 2.0 | 1.8 | 0.8 |
| | 4.3 | 2.6 | 3.6 | 2.6 | 1.7 | 0.7 |
| Average | 5.9 | 3.4 | 5.7 | 3.5 | 4.2 | 2.2 |

| | $Cl^-$ | $O_2$ | $N_2$ |
|---|---|---|---|
| Sample 1 | 0.007% | 4790 ppm | 152 ppm |
| Sample 2 | 0.018% | 3580 ppm | 151 ppm |
| Sample 3 | 0.027% | 7230 ppm | 165 ppm |

Though the present invention has been illustrated above in specific examples and drawings, the procedure of the invention and the apparatus to carry out the procedure obviously can be applied to compounds not mentioned and to apparatus not pictured above in view of the broader aspects of the invention.

We claim:

1. A reduction process for the production of a product metal which includes the step of reacting a reducible metal compound and a reducing metal in a sealed reaction zone by heating the reactants without any substantial agitation from a temperature below the melting point of the reducing metal to a temperature which is both above the melting point of the reducing metal and below the temperature at which the reduction reaction between the metal compound and the reducing metal will proceed spontaneously; initiating a reduction reaction between a reducible metal compound and a molten reducing metal by causing the surface of the molten reducing metal to be suddenly disrupted, thereupon releasing the reaction mixture from said first reaction zone into a product collection zone while permitting the reduction reaction to continue to thereby produce a reduced metal in zero valent state.

2. The process of claim 1, where the metal compound is a reducible metal compound selected from the group consisting of titanium, zirconium, hafmium, uranium, vanadium, niobium, thorium, beryllium, molybdenum and mixtures thereof.

3. The process of claim 1, in which the reducible metal compound is titanium tetrachloride.

4. The process of claim 1, where the reducible metal compound is zirconium tetrachloride.

5. The process of claim 1, wherein the reducible metal compound comprises a mixture of reducible metal compounds, comprising a major amount of a first reducible metal compound and a minor alloying amount of at least a second reducible metal compount.

6. A method as in claim 5, wherein the first reducible metal compound is titanium tetrachloride.

7. A method as in claim 6, wherein the second alloying reducible metal compound is a vanadium halide, an aluminum halide or mixtures thereof.

* * * * *